US005516092A

United States Patent [19]

Pollich

[11] Patent Number: 5,516,092

[45] Date of Patent: May 14, 1996

[54] SHEET-JOGGING DEVICE

[75] Inventor: Gerhard Pollich, Heidelberg, Germany

[73] Assignee: Heidelberger Druckmaschinen AG, Heidelberg, Germany

[21] Appl. No.: 271,721

[22] Filed: Jul. 7, 1994

[30] Foreign Application Priority Data

Jul. 7, 1993 [DE] Germany ..... 43 22 561.6

[51] Int. Cl.[6] ..... B65H 31/36

[52] U.S. Cl. ..... 271/221; 271/220

[58] Field of Search ..... 271/220, 221, 271/222

[56] References Cited

FOREIGN PATENT DOCUMENTS

| | | | |
|---|---|---|---|
| 2308576 | 11/1976 | France | 271/221 |
| 7513266 | 8/1976 | Germany . | |
| 7509912 | 10/1976 | Netherlands | 271/221 |

*Primary Examiner*—William E. Terrell

*Assistant Examiner*—T. Kelly

*Attorney, Agent, or Firm*—Herbert L. Lerner; Laurence A. Greenberg

[57] ABSTRACT

A sheet-jogging device in a delivery of a printing press with a press frame formed of side parts and having drives and a switching element therefor, a sheet-jogging device having at least one sheet-jogger reciprocatingly mounted in one of the side parts of the press frame so as to be adjustable to different sheet formats, and being tiltably supported, together with a bushing, in a lifting direction of a sheet pile so as to act on the switching element, includes a device for supporting the bushing in the one side part so that the supporting device is movable on all sides with respect to the direction of motion of the sheet-jogger, and a device for resiliently pretensioning the bushing into a given position of operation in which it counteracts deviating movements for moving the bushing out of the given position of operation, the switching element being provided for different drives and being actuatable by the deviating movements in different directions.

8 Claims, 4 Drawing Sheets

SHEET-JOGGING DEVICE

BACKGROUND OF THE INVENTION

Field of the Invention

The invention relates to a sheet-jogging device in a delivery of a printing press with a press frame formed of side parts and having drive means and a switching element therefor, the sheet-jogging device having at least one sheet-jogger reciprocatingly mounted in one of the side parts of the press frame so as to be adjustable to different sheet formats, and being tiltably supported, together with a bushing, in a lifting direction of a sheet pile so as to act on the switching element.

Such a sheet-jogging device has become known heretofore from the German Utility Model 75 13 266. According to the embodiment disclosed therein, it is possible for the sheet-jogger as such to perform a deviating tilting movement in lifting direction of the sheet pile and to thus act upon electrical switching elements provided for the electromotive drive of the lifting table in the delivery so that the drive is switched off if the lifting table or a pallet or other objects provided on the lifting table collide with the sheet-jogger. With the foregoing heretofore-known embodiment, this is achieved by providing the bearing bushing of the sheet-jogger with a butt-strap which is tiltably fastened to the side wall of the printing-press frame by bolting and tensioned springs, an actuating arm being disposed at the butt-strap and, as a result of the tilting movement, acting upon a switching element of the lifting-table drive. Such a safety mechanism is ineffective in cases wherein a possibly misaligned sheet-jogger collides with a gripper bar, the sheet-jogger coming into contact with adjustably arranged suction rollers, or other collisions caused by imprecise vertical movements.

SUMMARY OF THE INVENTION

It is therefore an object of the invention to provide a sheet-jogging device having an improved electrical safety mechanism for the sheet-jogger so that it becomes effective independently of the collision-causing direction of movement and of the machine or press part colliding with the sheet-jogger.

With the foregoing and other objects in view, there is provided, in accordance with the invention, in a delivery of a printing press with a press frame formed of side parts and having drive means and a switching element therefor, a sheet-jogging device having at least one sheet-jogger reciprocatingly mounted in one of the side parts of the press frame so as to be adjustable to different sheet formats, and being tiltably supported, together with a bushing, in a lifting direction of a sheet pile so as to act on the switching element, comprising means for supporting the bushing in the one side part so that the supporting means are movable on all sides with respect to the direction of motion of the sheet-jogger, and means for resiliently pretensioning the bushing into a given position of operation in which it counteracts deviating movements for moving the bushing out of the given position of operation, the switching element being provided for different drive means and being actuatable by the deviating movements in different directions.

The sheet-jogger is supported so as to be movable on all sides opposite to the direction of movement of the sheet-jogger; the sheet-jogger is also movably supported on the side wall of the machine frame in circumferential direction with respect to the axis of the jogging movement; and differently directed deviating movements of the sheet-jogger act on different switching elements of various drives provided for machine-movable machine or press parts in the delivery. As a result thereof, the sheet-jogger may deviate in horizontal direction, e.g., when coming into contact with a horizontally adjustable suction roller; or it may deviate by turning away, when a possibly misaligned sheet-jogger and a gripper bar come into contact; and, in so doing, it actuates different switching elements or one switching element for respective drives in order to switch off the switching element or elements. Thus, the inventive arrangement assures the construction of an electrical safety mechanism for the sheet-jogger, considering all conceivable collisions independently of the respective direction of action upon the sheet-jogger.

In accordance with another feature of the invention, the sheet-jogging device includes a bearing bushing, the first-mentioned bushing being rotatably movably and axially displaceably disposed in the bearing bushing so as to be movable on all sides in the side part, and an axially pretensioned spring and a spring pretensioned in direction of rotation being disposed between the bearing bushing and the side part.

In accordance with a further feature of the invention, the sheet-jogging device includes two rings mounted in the side part for supporting the bearing bushing, one of the rings being inserted in a bore formed with radial play in the side part, the other of the rings being disposed with radial play on the bearing bushing, both of the rings being braced axially loosely against one another, and being fixed, on the one hand, at the side part, against axial displacement in both directions and, on the other hand, at the bearing bushing, against axial displacement in one direction and, with respect to the other direction, the bearing bushing being loaded by the axially pretensioned spring on the side part.

In accordance with an added feature of the invention, a spherical joint formed of a spherical part fastened to the bearing bushing, and a calotte inserted in a bore formed in the side part is supported in the side part.

In accordance with an additional feature of the invention, the axially pretensioned spring is a cup spring braced, on the one hand, against an abutment provided on the bearing bushing and, on the other hand, against an abutment provided on the side part, the cup spring preloading the bearing bushing into a position of operation, and including stop means for limiting the position of operation so as to counteract deviating movements.

In accordance with yet another feature of the invention, the spring pretensioned in the direction of rotation serves for holding the first-mentioned bushing in the given position thereof against a stop located at the side part.

In accordance with yet a further feature of the invention, the sheet-jogging device includes another spring pretensioned in the direction of rotation opposite to the first-mentioned direction of rotation, the first-mentioned bushing being braced by both of the springs pretensioned in the respective opposite directions of rotation.

In accordance with a concomitant feature of the invention, there is provided a sheet-jogging device, in combination with an adjusting drive for a horizontally movable braking roller of the delivery, the bearing bushing being actuatable, in response to an approximately horizontal deviating movement, to act upon a switching element provided for the adjusting drive.

Other features which are considered as characteristic for the invention are set forth in the appended claims.

Although the invention is illustrated and described herein as embodied in a sheet-jogging device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DETAILED DESCRIPTION OF THE PREFERRED EMBODIMENT

Figure 1:
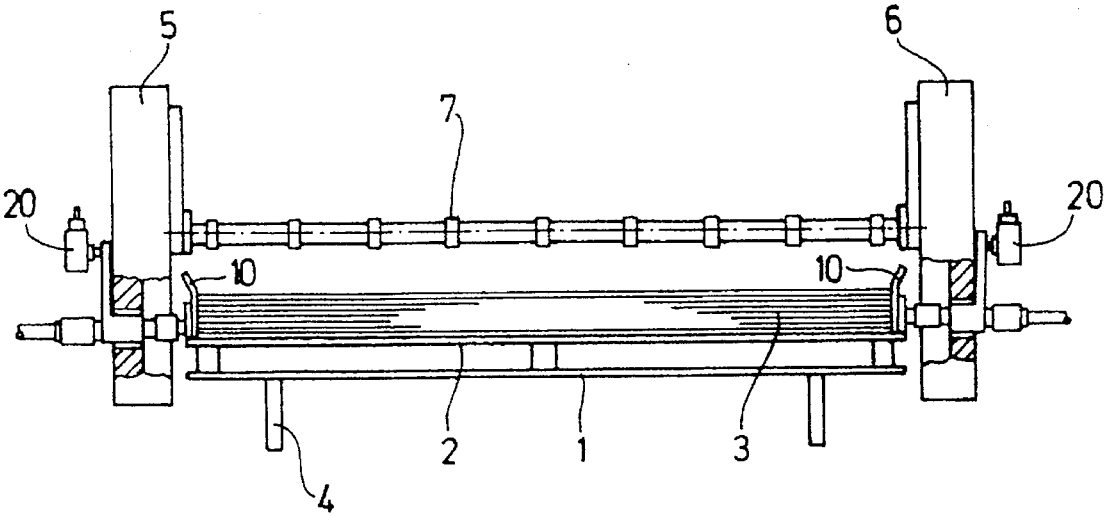
FIG. 1 is a front elevational view, partly broken away and in section, of a delivery of a printing press provided with two of the sheet-jogging devices according to the invention.
Figure 2:
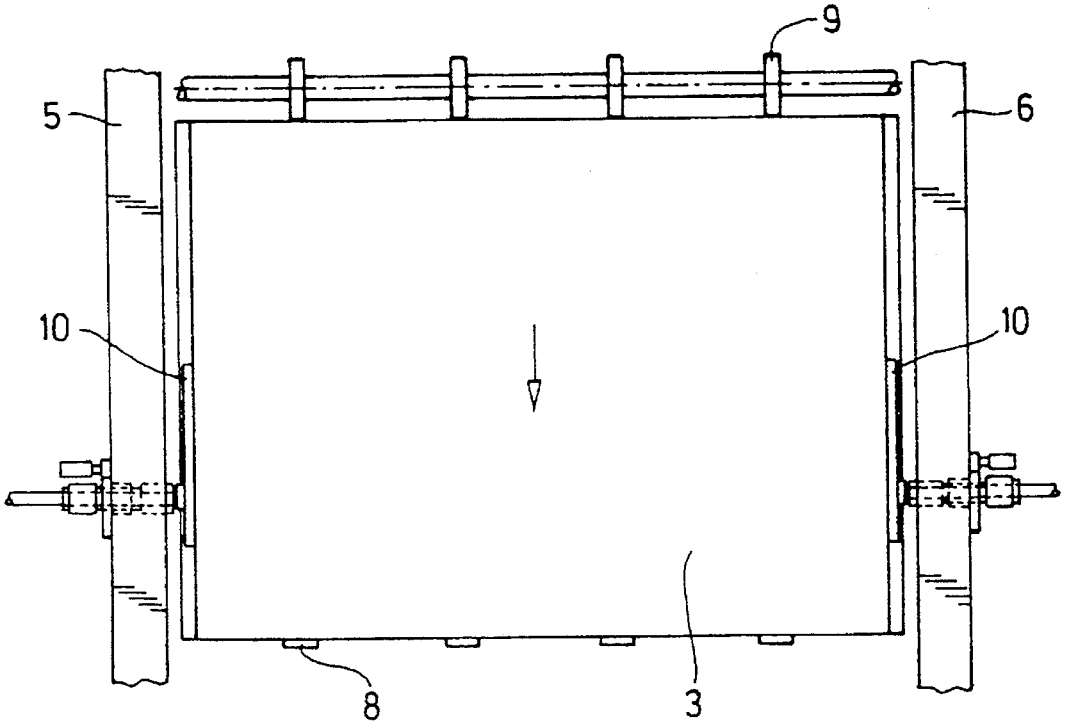
FIG. 2 is a top plan view of FIG. 1.

Referring now to the figures of the drawing and, first, particularly to FIGS. 1 and 2 thereof, there are shown sheets oncoming from a printing press which are deposited in a sheet pile 3 on a lifting table 1 or a pallet provided on such a lifting table in a delivery. The lifting table 1 disposed on supports 4 is vertically movable between side parts or walls 5 and 6 of the frame of the printing press by means of a conventional lifting unit not illustrated in the drawing. The sheets are conveyed by means of a conventional non-illustrated chain conveyor having conveying chains laterally revolving on the side parts 5 and 6, and gripper bars 7 attached thereto in a spaced relationship, sheet grippers being mounted on the gripper bars 7 for gripping the leading edge of a respective sheet at the printing press and releasing the sheet in order to deposit it on the sheet pile 3, so that the leading edge of the sheet abuts front stops 8. The sheet leaving the printing press is slowed down by suction rollers 9 acting as brake rollers. In order also to achieve a laterally neat sheet pile 3, sheet-joggers 10 are disposed on both sides thereof in the side parts 5 and 6 and executing a vertical reciprocating movement with respect to the lateral surface of the sheet pile 3. The sheet-jogger 10 is connected to a spindle 11 which is disposed in a bushing 12 so as to be adjustable in the direction of its axis and is lockable with respect to the bushing 12 by means of an adjusting screw 13. A drive for the reciprocating motion is effected by a drive cam 14 acting on a ball bearing 15 which is disposed on radially extending levers or on a radial flange of the bushing 12 and held against the drive cam 14 by a preloaded spring 16. Together with a spring 27 (FIG. 6), a second ball bearing 17, also disposed on a radial flange of the bushing 12, ensures guidance of the sheet-jogger 10 in axial direction of the bushing 12. The bushing 12 is disposed in a bearing bushing 18 so as to have a limited movement both in axial as well as in rotary direction, an actuating arm 19 being provided on the bearing bushing 18 for acting upon an actuating element of an electrical switching element 20.

Figure 6:
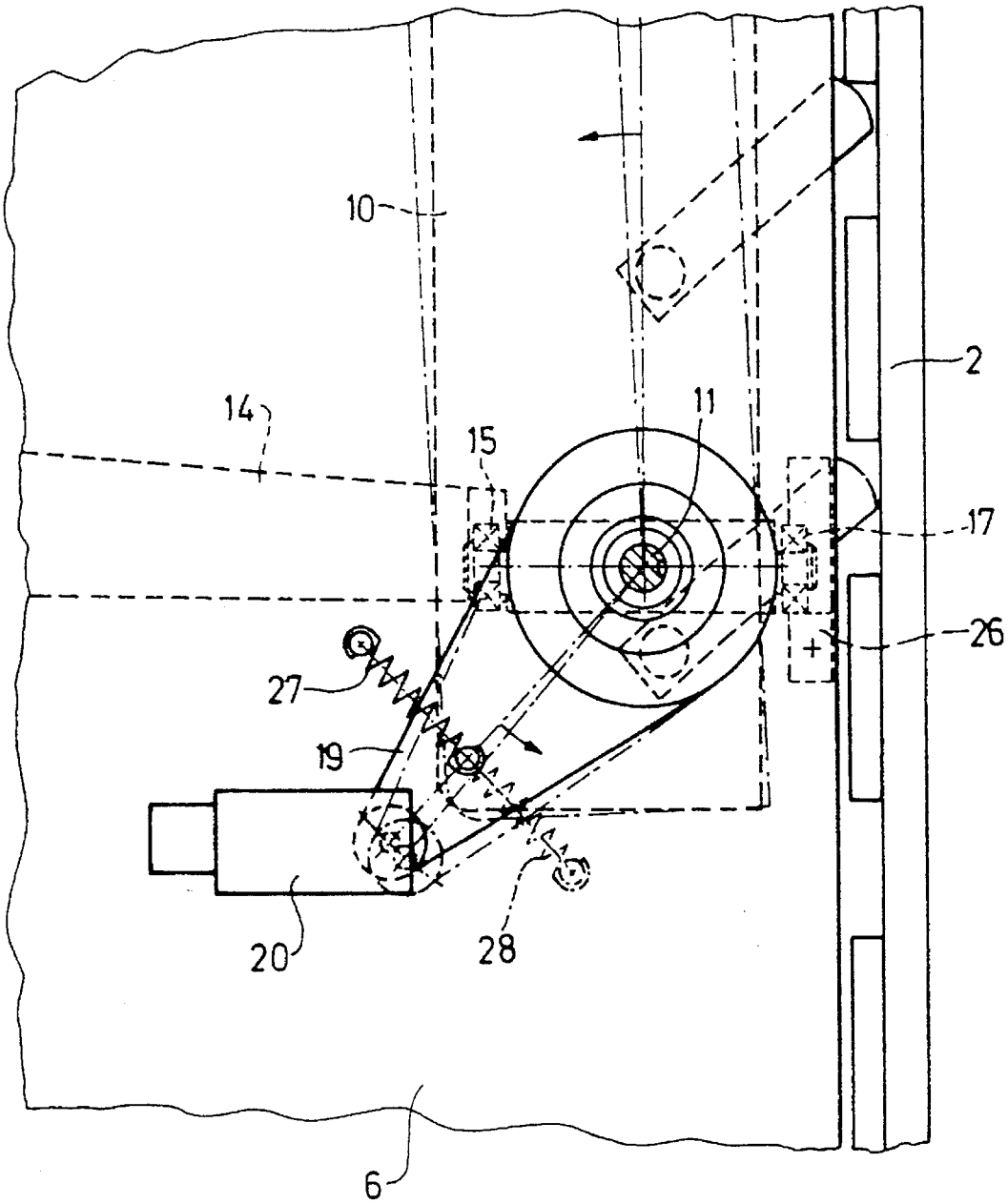
FIG. 6 is a right-hand side elevational view of FIG. 5.

According to FIG. 6, the bushing 12, in the direction of rotation thereof about the longitudinal axis thereof, is held, at an arm or flange 12*a* thereof, against a stop 26, by means of a spring 27, e.g. a helical spring, anchored to the side part 6 and acting upon an actuating arm 19 and thereby centered, so that the bushing 12 returns to this centered initial position after having executed a deviating movement in the direction of rotation. Via an adjusting spring or key 29, the bushing 12 is connected in a torsionally rigid manner to the bearing bushing 18, i.e., non-rotatable relative thereto, and thus also to the arm 19. It is conceivable to provide, instead of the stop 26, a further spring 28 extending in the direction of the action of the spring 27 in order to achieve a deviating movement in both directions of rotation against the spring action and to attain a centered intermediate position.

The bearing bushing 18 is supported in the side part 6 by means of two metal rings 21 and 22 which are mounted so as to be axially tiltable with respect to one another, the ring 21 thereof being inserted into the housing or side part 6 of the press frame with radial play, whereas the other ring 22 thereof surrounds the bearing bushing 18 with radial play, so that both rings 21 and 22 may execute tilting movements with respect to one another. The rings 21 and 22 are axially fixed with respect to the side part 6. Furthermore, the ring 21 is axially fixed with respect to the bearing bushing 18. Via a cup spring 23 braced, on the one hand, against the side wall 6 and, on the other hand, against the bearing bushing 18, the side part 6 and the bearing bushing 18 are axially braced one with the other. By overcoming the spring tension of the cup spring 23, the bearing bushing 18 with the bushing 12 guided therein and the spindle 11 to which the sheet-jogger 10 is fastened may execute tilting movements in any angular position. By overcoming the tension of the spring 27, in the one case, and of one of the springs 27 and 28, in the other case, respectively, the bushing may also execute a rotary movement so that one or more switching or actuating elements for the drives of machine elements provided in the delivery may be actuated due to the execution by the sheet-jogger 10 of deviating movements in the direction of rotation about the axis of the bushing and angularly with respect to this axis. With this arrangement, respectively, the cup spring 23 and the springs 27 and 28, respectively, automatically ensure a centered arrangement the instant the sheet-jogger 10 moves away from a colliding machine element.

Figure 3:
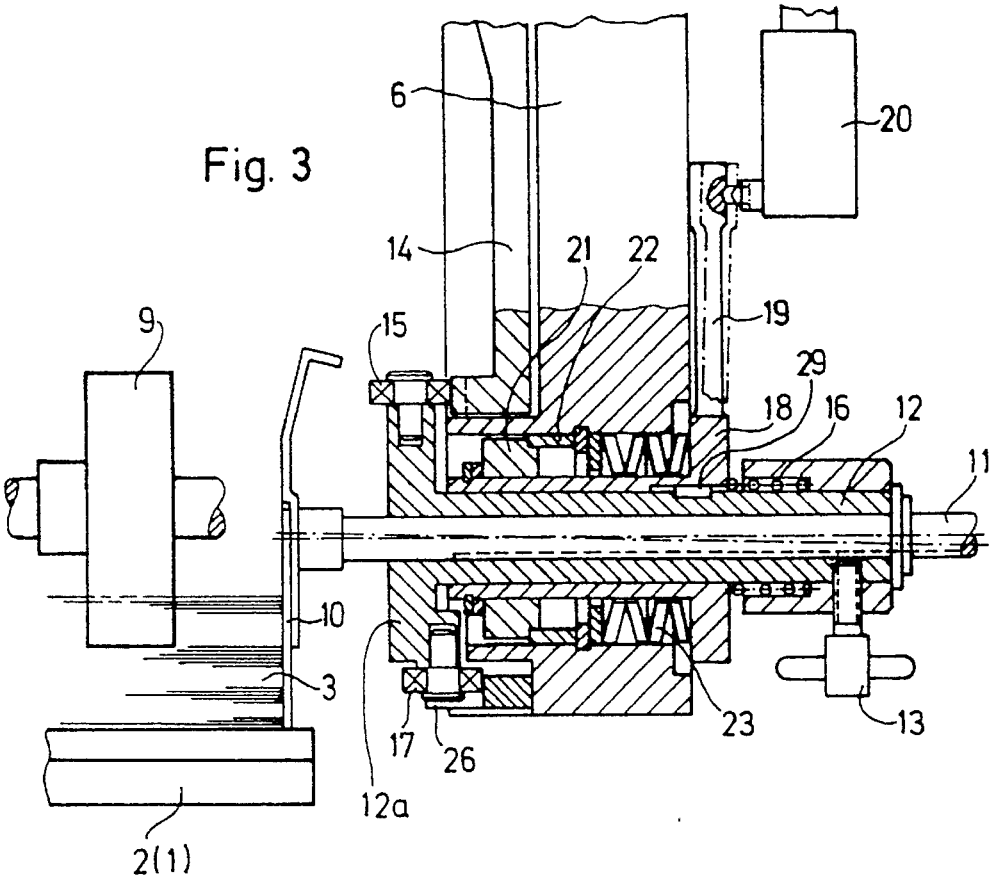
FIG. 3 is an enlarged fragmentary view of FIG. 1, showing one of the sheet-jogging devices mounted in a side wall of a press frame.
Figure 4:
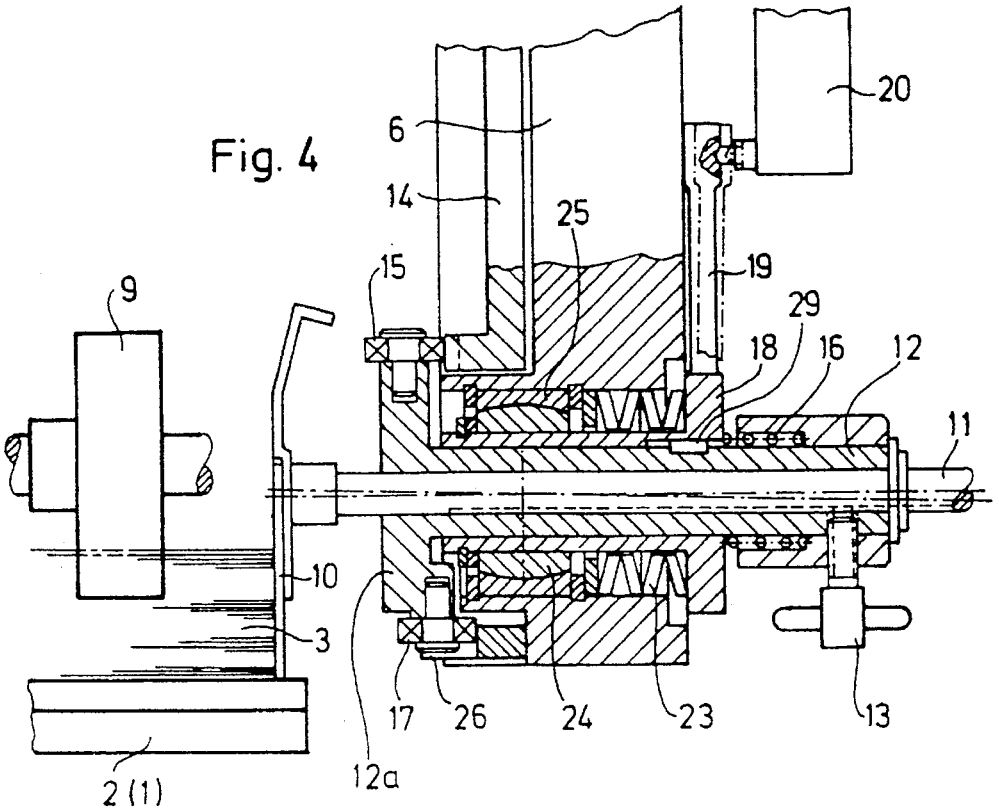
FIG. 4 is a view like that of FIG. 3 of another embodiment of the invention.
Figure 5:
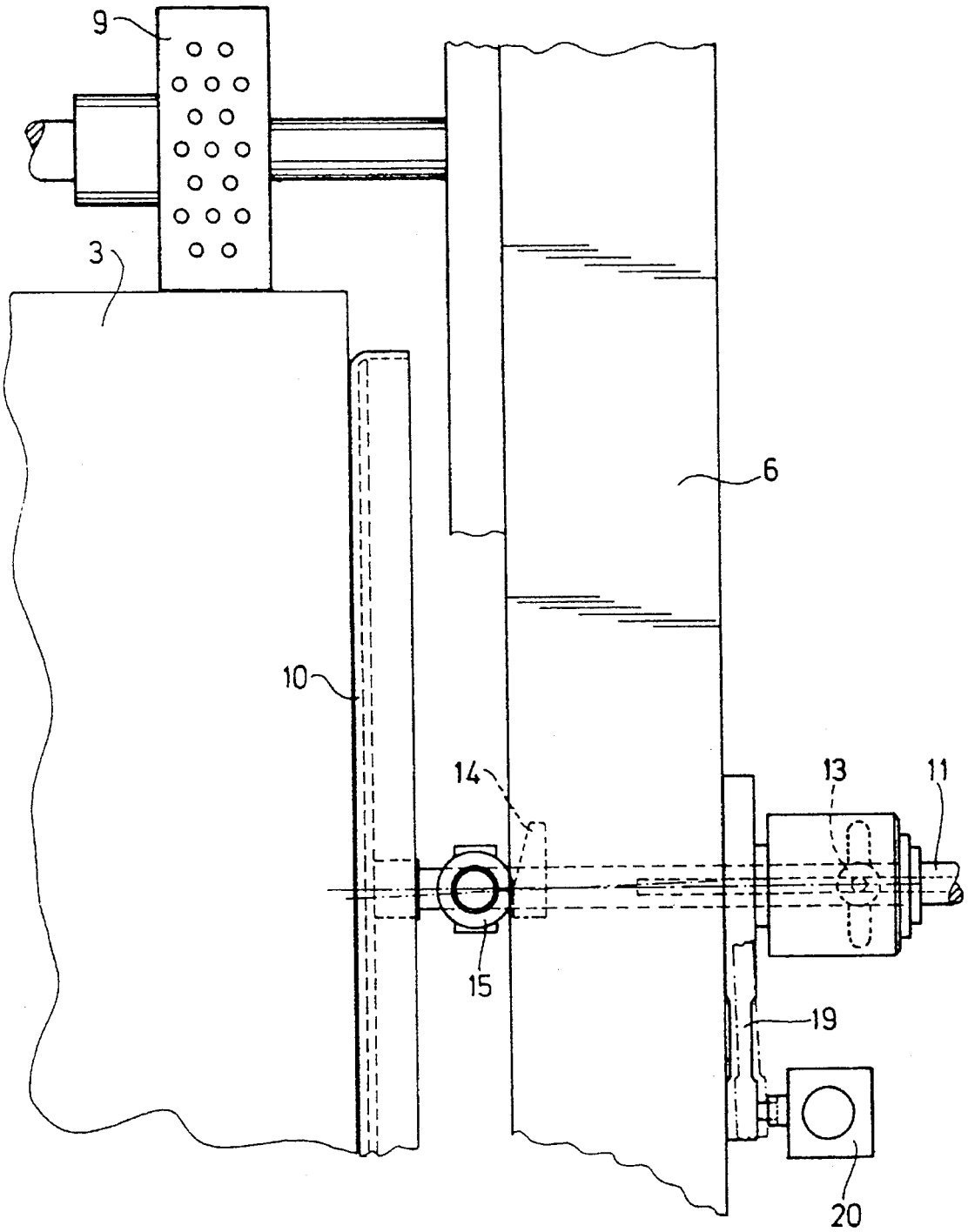
FIG. 5 is an enlarged top plan view of FIG. 3 or 4.

With the embodiment of the invention shown in FIG. 4, which is identical to the arrangement of FIG. 3 except that the bearing bushing 18 extends through a spherical universal-joint part 24 disposed provided in a spherical calotte 25 which, in turn, is axially fixed in the side part 6. The spherical part 24 is also axially fixed with respect to the bearing bushing 18 so that the bearing bushing 18 with the bushing 12 axially movably disposed therein, the spindle 11 and the sheet-jogger 10 attached thereto may execute swivelling movements about the center of the spherical part 24. With this arrangement, too, the bearing bushing 18 is braced axially with the side part 6, by means of a cup spring 23, on the one hand, against the side part 6 and, on the other hand, against the bearing bushing 18, so that swivelling movements may be executed about the center of the spherical or ball joint by overcoming the spring forces, and so that the spring may automatically cause the arrangement to be centered the instant the sheet-jogger 10 moves away from possible obstacles.

I claim:

1. In a delivery of a printing press with a press frame formed of side parts and having drive means and a switching element therefor, a sheet-jogging device having at least one sheet-jogger reciprocatingly mounted in one of the side parts of the press frame so as to be adjustable to different sheet formats, and being tiltably supported, together with a bushing, in a lifting direction of a sheet pile so as to act on the switching element, comprising means for supporting the bushing in the one side part so that said supporting means are movable in all directions with respect to the direction of motion of the sheet-jogger, and means for resiliently pretensioning the bushing into a given position of operation in which it counteracts deviating movements for moving the bushing out of the given position of operation, the switching element being actuatable by the deviating movements in different directions.

2. Sheet-jogging device according to claim 1, including a bearing bushing, the first-mentioned bushing being rotatably movably and axially displaceably disposed in said bearing bushing so as to be movable in all directions all sides in the side part, and an axially pretensioned spring and a spring pretensioned in direction of rotation being disposed between said bearing bushing and the side part.

3. Sheet-jogging device according to claim 2, wherein a spherical joint formed of a spherical part fastened to said bearing bushing, and a calotte inserted in a bore formed in the side part is supported in the side part.

4. Sheet-jogging device according to claim 2, wherein said axially pretensioned spring is a cup spring braced, on the one hand, against an abutment provided on said bearing bushing and, on the other hand, against an abutment provided on the side part, said cup spring preloading said bearing bushing into a position of operation, and including stop means for limiting said position of operation so as to counteract deviating movements.

5. Sheet-jogging device according to claim 2, wherein said spring pretensioned in the direction of rotation serves for holding the first-mentioned bushing in the given position thereof against a stop located at the side part.

6. Sheet-jogger device according to claim 2, including another spring pretensioned in the direction of rotation opposite to the first-mentioned direction of rotation, the first-mentioned bushing being braced by both of the springs pretensioned in the respective opposite directions of rotation.

7. Sheet-jogging device according to claim 2, wherein said bearing bushing, in response to an approximately horizontal deviating movement, actuates a horizontally movable braking roller of the delivery.

8. Sheet-jogging device according to claim 2, including two rings mounted in the side part for supporting said bearing bushing, one of said rings being inserted in a bore formed with radial play in the side part, the other of said rings being disposed with radial play on said bearing bushing, both of said rings being braced axially loosely against one another, and being fixed, on the one hand, at the side part, against axial displacement in both directions and, on the other hand, at said bearing bushing, against radial displacement in one direction and, with respect to the other direction, said bearing bushing being loaded by said axially pretensioned spring on the side part.

* * * * *